US011458611B2

(12) United States Patent
Sand

(10) Patent No.: US 11,458,611 B2
(45) Date of Patent: Oct. 4, 2022

(54) BENDABLE PARTITION FOR STORAGE SURFACE

(71) Applicant: Michael F. Sand, Lisbon, ND (US)

(72) Inventor: Michael F. Sand, Lisbon, ND (US)

( * ) Notice: Subject to any disclaimer, the term of this patent is extended or adjusted under 35 U.S.C. 154(b) by 0 days.

(21) Appl. No.: 17/027,355

(22) Filed: Sep. 21, 2020

(65) Prior Publication Data

US 2022/0088765 A1 Mar. 24, 2022

(51) Int. Cl.

| | |
|---|---|
| ***B25H 3/02*** | (2006.01) |
| ***A47B 88/975*** | (2017.01) |
| ***A47B 88/988*** | (2017.01) |

(52) U.S. Cl.

CPC ..... *B25H 3/02* (2013.01); *A47B 88/975* (2017.01); *A47B 88/988* (2017.01)

(58) Field of Classification Search

CPC ... A47B 88/975; A47B 88/969; A47B 88/981; A47B 88/988; A47B 88/994; A47B 88/976; B25H 3/02

USPC ..... 312/348.3, 404; 211/184, 59.3; 220/529; 206/373

See application file for complete search history.

(56) References Cited

U.S. PATENT DOCUMENTS

| | | | | |
|---|---|---|---|---|
| 2,094,805 | A * | 10/1937 | Meier | B25H 3/02 144/285 |
| 3,874,753 | A * | 4/1975 | Naito | A47B 47/0041 312/111 |
| 5,553,710 | A | 9/1996 | Takama | |
| 5,853,239 | A | 12/1998 | Laib et al. | |
| 6,923,317 | B2 * | 8/2005 | Coleman, Jr. | B25H 3/003 206/378 |
| 2003/0137227 | A1 * | 7/2003 | Hoenig | A47B 88/975 312/348.3 |
| 2005/0051444 | A1 | 3/2005 | Hurt et al. | |
| 2006/0011686 | A1 * | 1/2006 | Latham | B60R 7/04 224/579 |
| 2009/0052809 | A1 * | 2/2009 | Sampson | B65D 81/389 220/592.2 |

(Continued)

FOREIGN PATENT DOCUMENTS

| | | | |
|---|---|---|---|
| DE | 202017106273 | U1 | 12/2017 |
| JP | 4191443 | B2 | 12/2008 |
| JP | 2004049475 | A | 12/2008 |

OTHER PUBLICATIONS

Adjustable Drawer Partitions'. Quick and Clever Workshop Storage Solutions [online]. The Family Handyman. [retrieved on Sep. 21, 2020]. Retrieved from the Internet: <URL: https://www.familyhandyman.com/list/quick-and-clever-workshop-storage-solutions/>.

*Primary Examiner* — Rafael A Ortiz
*Assistant Examiner* — Sanjidul Islam
(74) *Attorney, Agent, or Firm* — Snell & Wilmer L.L.P.

(57) ABSTRACT

A storage system is disclosed, and that may be in the form of a drawer, shelf, or the like. One or more customized, flexible partitions may be attached to a relevant storage surface. For instance, each partition may be cut to a desired length from a bulk source (e.g., a roll). Moreover, each partition may be flexed into a desired shape and then adhesively bonded to a relevant storage surface. A release liner may be removed from a bottom surface of the partition to adhesively bond the partition to the relevant storage surface. Double-sided adhesive tape could also be applied to the bottom surface of the partition to adhesively bond the partition to the relevant storage surface.

13 Claims, 5 Drawing Sheets

(56) References Cited

U.S. PATENT DOCUMENTS

| | | | | |
|---|---|---|---|---|
| 2009/0159541 | A1* | 6/2009 | Burgess | A47B 88/994 211/70.7 |
| 2013/0020270 | A1* | 1/2013 | Valiulis | A47F 5/005 211/59.2 |
| 2015/0305501 | A1* | 10/2015 | Brown | A47B 88/90 312/348.3 |
| 2016/0243695 | A1* | 8/2016 | Billups, Jr. | B25H 3/003 |
| 2017/0007048 | A1* | 1/2017 | Lucken | A47G 19/02 |
| 2017/0245667 | A1* | 8/2017 | Gaines | A01K 13/001 |
| 2018/0022513 | A1* | 1/2018 | Kerstetter | B65D 47/122 222/1 |
| 2018/0344028 | A1 | 12/2018 | Vold | |
| 2019/0100370 | A1 | 4/2019 | Kieling et al. | |

* cited by examiner

BENDABLE PARTITION FOR STORAGE SURFACE

FIELD

The present disclosure generally relates to the field of managing a storage surface and, more particularly, to a partition or divider that may be flexed into a desired shape for attachment to a storage surface.

BACKGROUND

There are a number of options for organizing storage spaces, such as the interior of a drawer. Various types of utensil organizers are available, where these utensil organizers are configured to be inserted into the storage space of a drawer. The storage space of some drawers may be segregated into a plurality separate spaces or compartments by one or more partitions or dividers. The ends of at least certain known partitions include some type of connector for maintaining the partition in a certain position relative to a remainder of the drawer.

SUMMARY

The present invention pertains to a partition or a divider that is of a configuration that readily accommodates customizing a storage space. The partition may be cut to a customized length from a bulk source, such as a roll or the like. The partition is sufficiently flexible, pliable, or the like such that it may be readily manipulated into a desired shape or contour exclusively by hand (e.g., without tooling; simply by exerting hand-generated forces on the partition). A bottom surface of the partition incorporates a separate adhesive (e.g., the partition and adhesive are different components, formed from different materials, or both) such that the partition may be adhesively bonded to a storage surface, such as a bottom of a drawer, a storage surface of a shelf, or the like. This adhesive bond may provide the entirety of the attachment, anchoring or "fixing" of the partition to the storage surface—no end connectors or the like are required in order for one or more partitions to be disposed in an arrangement that provides a storage space or compartment with a closed perimeter, for instance.

One or more partitions may be anchored or fixed to the storage surface (via an adhesive bond) and may have their corresponding length dimension be axially extending. One or more partitions may be anchored to the storage surface in a configuration where a given partition includes one or more sections that are curved proceeding along their corresponding length dimension. A given partition may include one or more axial or "straight" sections, one or more curved sections, or any combination thereof. The partition may be anchored to the support surface (via an adhesive bond) so as to be disposed about at least part of (and including the entirety of) a perimeter of an object (e.g., a tool) disposed on the storage surface.

The partition may include a base and an upper segment that extends away from the base (e.g., vertically or upwardly when the base is disposed on a horizontal supporting surface). Both the base and the upper segment may extend along at least substantially an entirety of (and including for the entirety of) the length of the partition. The base may be wider than the upper segment, with the width dimension of the base and the upper segment both being orthogonal to the length dimension of the partition, with the base being positioned on the storage surface, and with the adhesive bond being between the base of the partition and the storage surface. The base has a width of at least about 0.488" in one embodiment and a height of about 0.16" in one embodiment. The upper segment has a width of about 0.125" in one embodiment and the upper segment has a height within a range of about 0.375" to about 6" in one embodiment.

The function of the base having a minimum width of approximately 0.488" is to provide enough surface area for the adhesive to make an adequately strong bond to prevent the partition from inadvertently being dislodged if it is pushed against or the upper segment is bent over. This width of the base allows the adhesive to provide a strong enough bond to allow the upper segment to be bent completely over without the adhesive base being removed (e.g., without the adhesive bond between the base and the storage surface being disrupted; without the base becoming dislodged from the storage surface). A larger base would take up unnecessarily large amounts of the storage space and be less cosmetically pleasing. The upper segment having a width of about 0.125" provides a thin upper partition so not to take up excess storage space. A width of about 0.125" thick, along with a Shore Hardness of about 85A, makes the upper segment adequately stiff enough to remain in an upright position even if objects are resting on or against it. A width about 0.125" and Shore Hardness of about 85A is also thin and flexible enough to allow the upper segment to be bent over and not put a large enough moment (torque) on the base to dislodge the adhesive.

An adhesive layer or film may be incorporated on the bottom surface of the partition (e.g., the base). A release liner may be disposed over this adhesive layer or film, and would be removed prior to adhesively bonding the partition to the storage surface. Double-sided adhesive tape (e.g., an acrylic tape or foam acrylic tape) may also be attached to the bottom surface of the partition (e.g., on the base) and may provide the adhesive bond between the partition and the storage surface. In both instances, the adhesive may be an acrylic adhesive. The bottom surface of the partition may include a recess, and an adhesive may be disposed in this recess. The function of the recess is to provide a location for the adhesive such that the adhesive will be concealed when the partition is installed on the storage surface. This makes the partition more cosmetically pleasing, as well as helps eliminate cracks where dust can collect/catch and not be easily cleaned. One embodiment has the recess with a width of about 0.47" and a depth of about 0.035".

The partition may be formed from any appropriate material including natural rubber, flexible PVC, EPDM rubber, and thermoplastic elastomers (e.g., natural rubber, flexible PVC, EPDM rubber, chloroprene, neoprene, nitrile rubber, fluoroelastomer, styrene-butadiene rubber, styrene-ethylene-butylene-styrene, thermoplastic vulcanizates, thermoplastic olefin, thermoplastic polyurethane, polyethylene, polypropylene (styrene-ethylene-butylene-styrene, thermoplastic vulcanizates, and thermoplastic polyurethane are all in the broader thermoplastic elastomer group)).

Various aspects of the present invention are also addressed by the following paragraphs and in the noted combinations:

1. A storage system comprising:

a storage surface; and a partition that is attached to said storage surface by an adhesive bond between a bottom surface of said partition and said storage surface, wherein said partition is flexible along a length dimension of said partition prior to being adhesively bonded to said storage surface.

2. The storage system of paragraph 1, further comprising:

a drawer that in turn comprises a drawer bottom, wherein said storage surface defines said drawer bottom.

3. The storage system of paragraph 2, further comprising a tool disposed on said drawer bottom, wherein said partition at least generally approximates a perimeter of at least a portion of said tool.

4. The storage system of paragraph 2, further comprising a tool disposed on said drawer bottom, wherein said partition extends along at least part of a first side of said tool, around an end of said tool, and along at least part of a second side of said tool opposite said first side.

5. The storage system of paragraph 1, further comprising:

a shelf that in turn comprises an upper shelf surface, wherein said upper shelf surface comprises said storage surface.

6. The storage system of paragraph 5, wherein said storage surface is one of horizontally disposed or disposed at an angle relative to horizontal.

7. The storage system of any of paragraphs 5-6, further comprising a first component disposed on said upper shelf surface, wherein said partition is disposed between said first component and a first edge of said shelf.

8. The storage system of any of paragraphs 1-7, wherein said partition comprises a T-shaped cross-section taken perpendicular to said length dimension.

9. The storage system of any of paragraphs 1-8, wherein said partition comprises a base and an upper segment extending upwardly from said base, and wherein said base comprises said bottom surface.

10. The storage system of paragraph 9, wherein a width of said base is larger than a width of said upper segment.

11. The storage system of any of paragraphs 9-10, wherein said upper segment is disposed at least generally at a middle of said base relative to a width dimension of said base that is orthogonal to said length dimension of said partition.

12. The storage system of any of paragraphs 9-11, wherein said partition comprises a release liner disposed over adhesive on said bottom surface, wherein said release liner is removable to expose said adhesive prior to disposing said partition on said storage surface.

13. The storage system of paragraph 12, wherein said adhesive is an acrylic adhesive.

14. The storage system of paragraph 12, further comprising a double-sided adhesive tape mounted to said bottom surface of said base.

15. The storage system of any of paragraphs 1-8, further comprising a double-sided adhesive tape attached to said bottom surface of said partition.

16. The storage system of any of paragraphs 1-8, further comprising at least one of an adhesive layer or an adhesive film on said bottom surface of said partition, along with an associated release liner, wherein said adhesive layer and adhesive film comprise an acrylic adhesive.

17. The storage system of any of paragraphs 1-16, wherein said partition is formed from a material selected from the group consisting of natural rubber, flexible PVC, EPDM rubber, and thermoplastic elastomers.

18. The storage system of any of paragraphs 1-17, wherein said partition comprises a Shore Hardness within a range of about 70A to about 90A.

19. The storage system of paragraph 18, wherein said partition comprises a Shore Hardness of about 85A.

20. The storage system of any of paragraphs 1-19, wherein a flexibility of said partition allows said partition to be bent to include a curved section having a minimum radius of about 1".

21. The storage system of any of paragraphs 1-20, wherein said partition comprises a plurality of curved sections proceeding along said length dimension of said partition and that are of different configurations.

22. The storage system of any of paragraphs 1-21, wherein said bottom surface of said partition comprises a recess and adhesive disposed in said recess.

23. The storage system of any of paragraphs 1-22, wherein said partition is fixed to said storage surface exclusively by said adhesive bond between said bottom surface of said partition and said storage surface.

24. A method of partitioning a storage space, comprising the steps of:

flexing a partition into a first shape so as to have at least one curvature along a length dimension of said partition; and adhesively bonding a bottom surface of said partition to a storage surface with said partition at least substantially remaining in said first shape on said storage surface.

25. The method of paragraph 24, wherein said storage surface defines a bottom of a drawer.

26. The method of paragraph 25, further comprising placing a tool on said drawer bottom, wherein said partition at least generally approximates a perimeter of at least a portion of said tool.

27. The method of paragraph 25, further comprising placing a tool on said drawer bottom, wherein said partition extends along at least part of a first side of said tool, around an end of said tool, and along at least part of a second side of said tool opposite said first side.

28. The method of any of paragraphs 24-27, wherein said flexing step comprises forming a plurality of different curved sections proceeding along said length dimension of said partition.

29. The method of any of paragraphs 24-28, further comprising:

removing a release liner from said bottom surface of said partition and that exposes an adhesive, wherein said adhesively bonding step is executed after said removing step.

30. The method of any of paragraphs 24-28, further comprising:

attaching a double-sided adhesive tape to said bottom surface of said partition, wherein said adhesively bonding step is executed after said attaching step.

31. The method of any of paragraphs 24-30, further comprising:

cutting said partition to a first length prior to said adhesively bonding step.

32. The method of any of paragraphs 24-31, further comprises fixing said partition to said storage surface using only said adhesively bonding step.

33. The method of any of paragraphs 24-32, further comprising disposing a base of said partition on said storage surface, where said base comprises said bottom surface, wherein said partition comprises an upper segment that extends upwardly from said base, wherein each of said base and said upper segment extend along at least substantially an entirety of said length dimension of said partition, wherein said base is of a first width, wherein said upper segment is of a second width, wherein a width dimension of each of said base and said upper segment is orthogonal to said length dimension of said partition, and wherein said first width of said base is larger than said second width of said upper segment.

DETAILED DESCRIPTION

Figure 1:
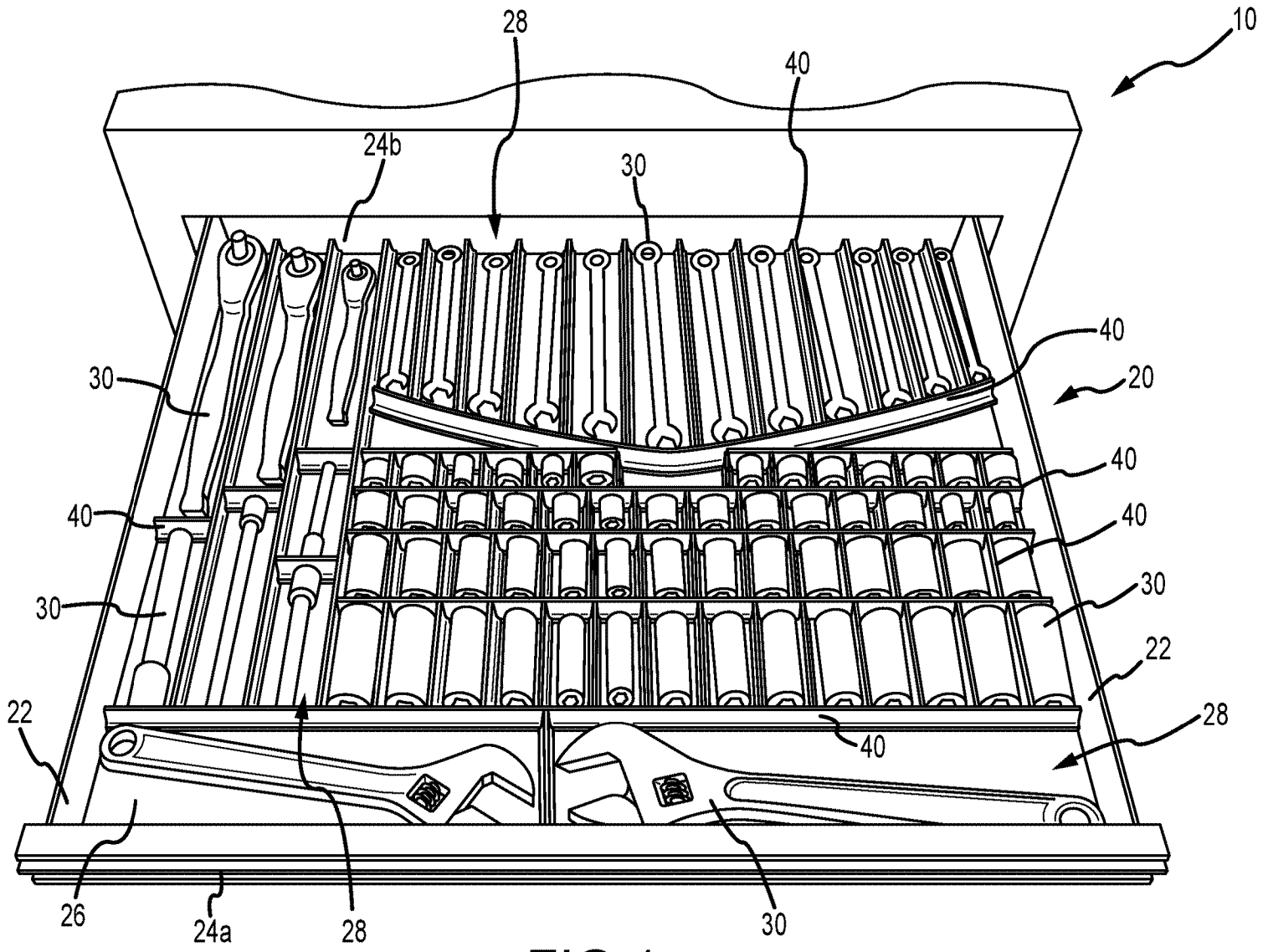
FIG. 1 a perspective view of a drawer that includes a plurality of flexible/bendable partitions that are adhesively bonded to a bottom of the drawer.

FIG. 1 illustrates an embodiment of a storage system that is identified by reference numeral 10 and that includes a drawer 20. The storage system 10 may be of any appropriate size, shape, configuration, and/or type (e.g., a toolbox or tool chest), and may include one or more drawers 20 of any appropriate size, shape, and/or configuration. The drawer 20 includes a pair of laterally-spaced sides 22 (spaced from one another in a width dimension of the drawer 20), a front wall 24*a* and a rear wall 24*b* that are spaced from another in a longitudinal dimension for the drawer 20 (the longitudinal dimension being orthogonal to the noted width dimension for the drawer 20), and a bottom or storage surface 26.

A plurality of individual/separate partitions 40 are each adhesively bonded to the bottom 26 of the drawer 20. Each of the partitions 40 may be separately manipulated into any appropriate shape or contour (e.g., by flexing or bending a particular partition 40 along its length dimension) to provide one or more storage compartments 28 (e.g., FIGS. 1 and 5) of a desired size and/or shape within the storage space of the drawer 20. In the illustrated embodiment a single tool 30 is disposed in each storage compartment 28, where each tool 30 may be of any appropriate type (e.g., crescent wrenches, sockets, ratchets, ratchet extensions, combination wrenches (e.g., each having an open end in a box end)). It should be appreciated that multiple tools 30 could also be disposed in a given storage compartment 28 of the drawer 20.

Figure 2:
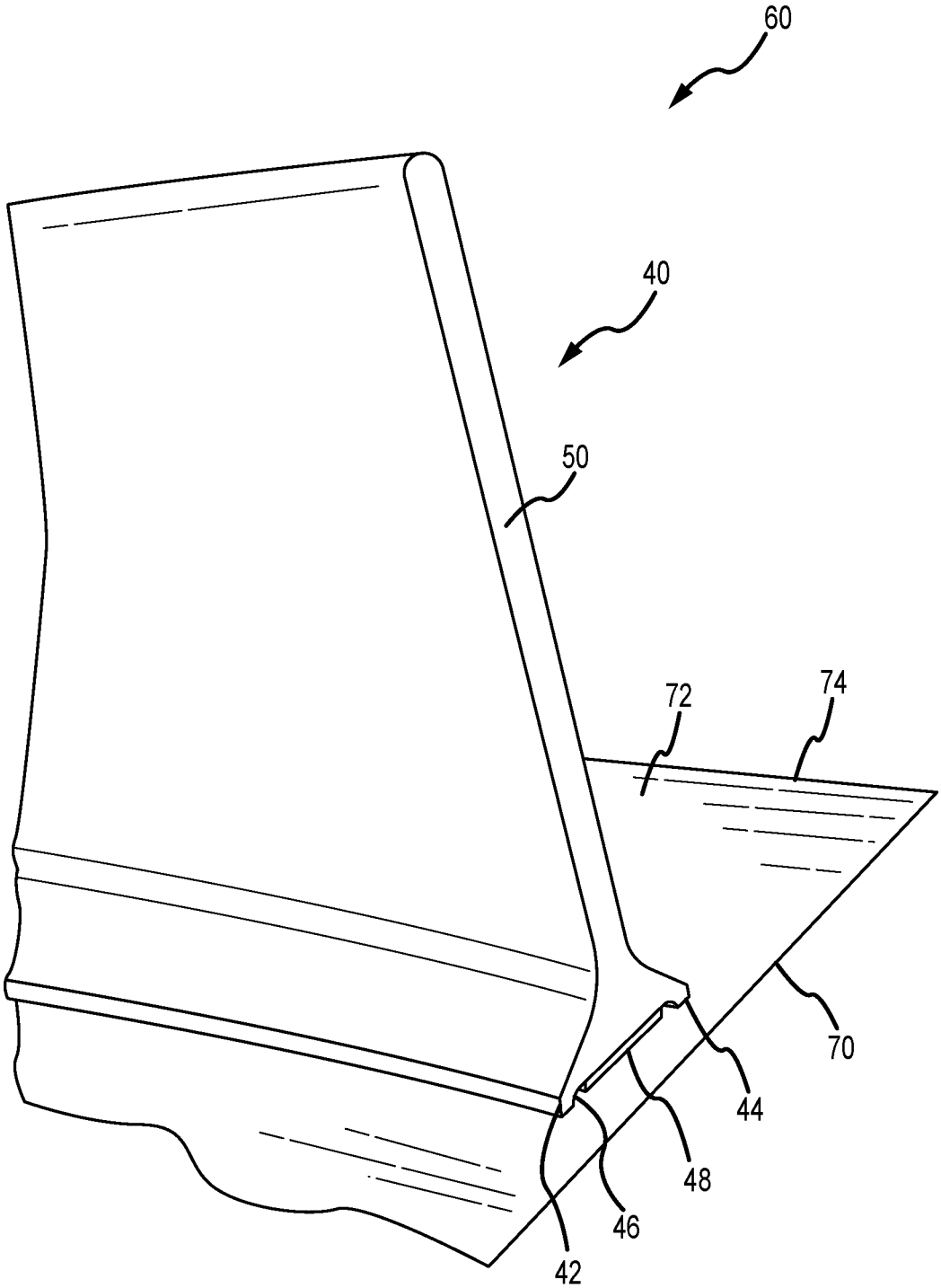
FIG. 2 is a perspective view of a shelf that includes a flexible/bendable partition that is adhesively bonded to an upper surface of the shelf.

FIG. 2 illustrates an embodiment of a storage system that is identified by reference numeral 60 and that includes a shelf 70. The shelf 70 includes an upper or storage surface 72 and a pair of longitudinal edges 74 (only one shown in FIG. 2) that each extend along a length dimension of the shelf 70. The shelf 70 may be formed from any appropriate material or combination of materials, may be of any appropriate length, and may be of any appropriate width (the dimension corresponding with the spacing between the noted longitudinal edges 74). Moreover, the shelf 70 may be disposed in any appropriate orientation, for instance with its upper surface 72 being horizontally disposed or disposed at an incline (e.g., such that one of its longitudinal edges 74 is disposed at a different elevation than the other of its longitudinal edges 74). One or more partitions 40 may be adhesively bonded to the upper surface 72 of the shelf 70. Each partition 40 may be hand-manipulated into any appropriate shape or contour (e.g., by flexing or bending a particular partition 40) for attachment to the shelf 70. For instance, a partition 40 could be disposed parallel to the longitudinal edges 74 of the shelf 70, and may be spaced from a first of the longitudinal edges 74 (e.g., disposed at a higher elevation), to restrain movement of one or more objects in the direction of a second of the longitudinal edges 74 (e.g., disposed at a lower elevation).

Figure 3:
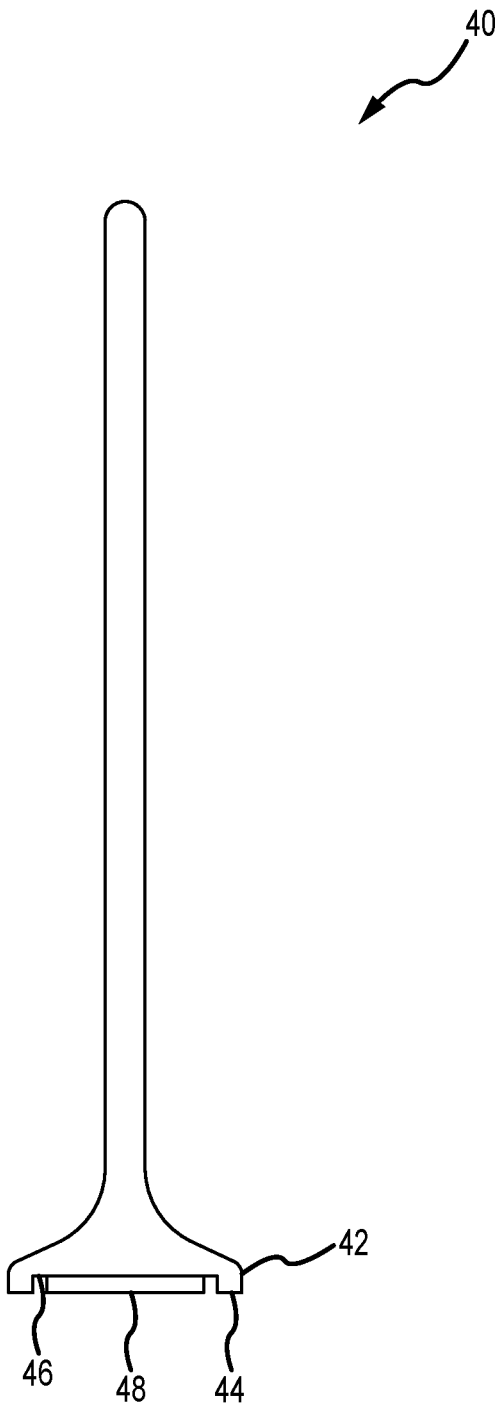
FIG. 3 is an end view of the partitions shown in FIGS. 1-2.
Figure 4:
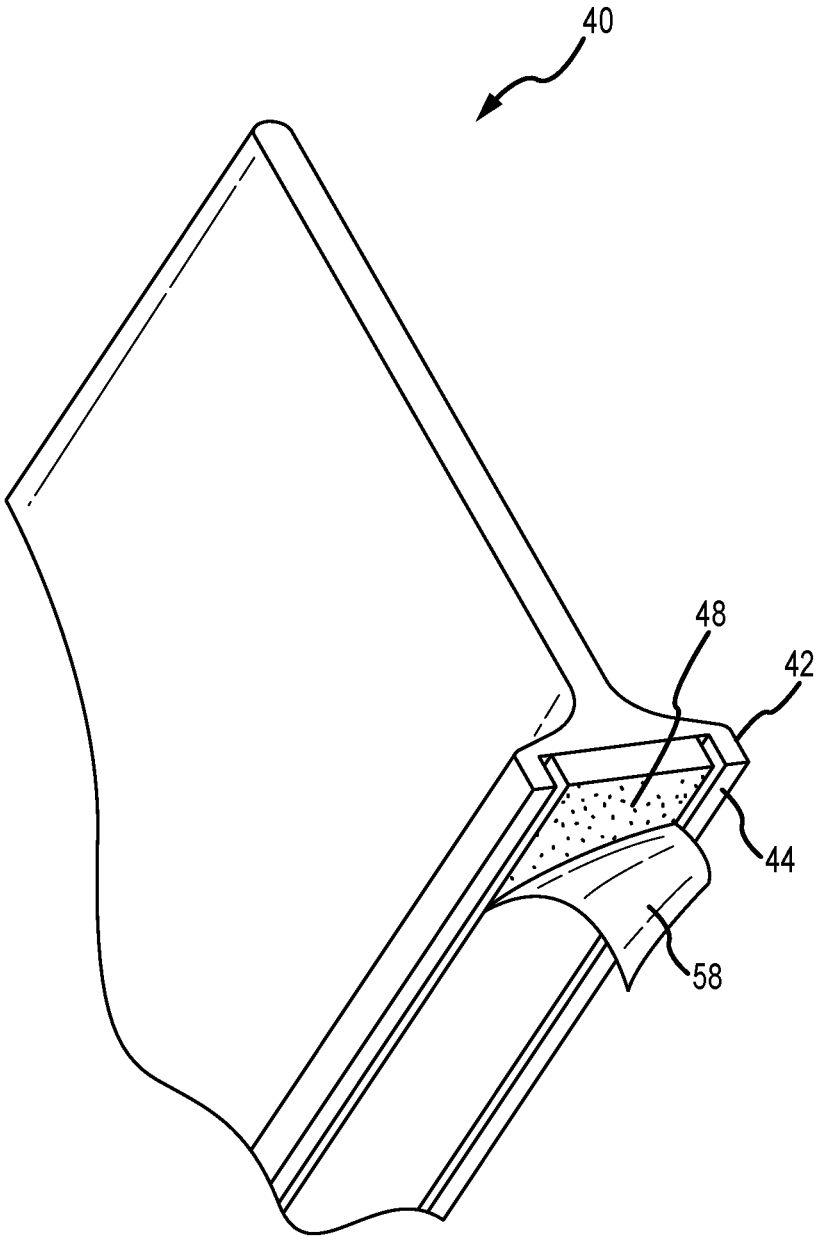
FIG. 4 is a perspective view, from the bottom, of an embodiment of the partitions shown in FIGS. 1-2.
Figure 5:
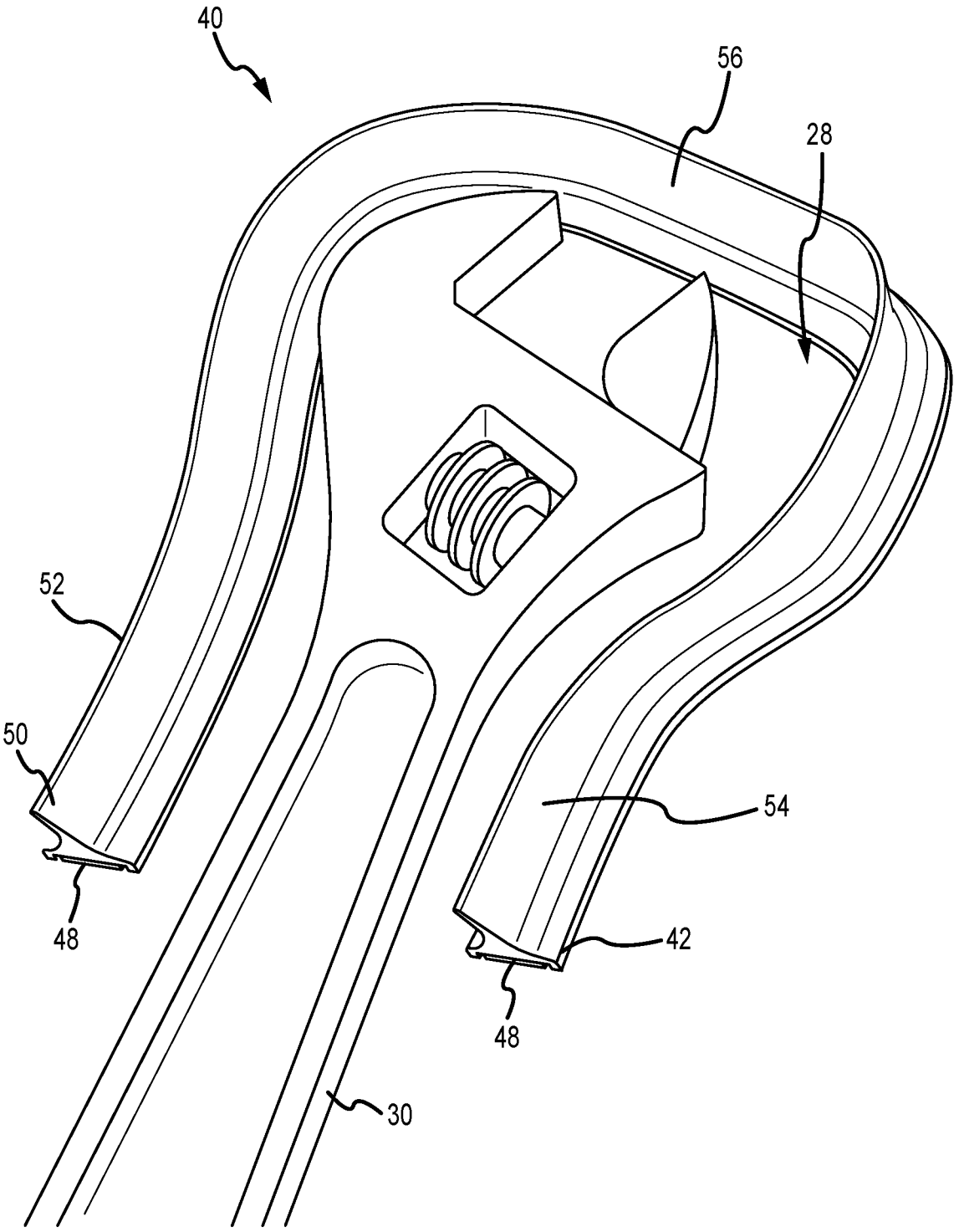
FIG. 5 is a perspective view of a partition that has been configured to at least generally approximate portion of a perimeter of a tool disposed on a storage surface.

One or more features of the above-noted partitions 40 are illustrated in FIGS. 3-4 (further details being shown in FIG. 5). The partition 40 includes a base 42 and an upper segment 50 that extends away from the base 42 (e.g., vertically, when the base 42 is disposed on a horizontal surface). In one embodiment the base 42 and upper segment 50 are integrally-formed or of an integral construction (e.g., of one-piece construction; with no joint between the base 40 and upper segment 50). Both the base 42 and the upper segment 50 may extend along at least substantially an entirety of length of the partition 40 (including extending along the entire length of the partition 40).

The base 42 of the partition 40 includes a bottom surface 44 that is disposed on or projects toward/faces the relevant storage surface. The bottom surface 44 of the base 42 may include a recess 46 that may extend along the entire length of the partition 40. An appropriate adhesive or adhesive film/layer 48 may be disposed within this recess 46 (e.g., the partition 40 and the adhesive 48 are separate components, and are formed from different materials). One option is for the partition 40 to include a release liner 58 that is positioned over the adhesive layer 48 and that may be removed prior to adhesively bonding (via the adhesive layer 48) the partition 40 to a desired storage surface. Another option is for the adhesive layer 48 to be in the form of a double-sided adhesive tape that is secured to the bottom surface 44 of the base 42 prior to adhesively bonding (again, via the adhesive layer 48) the partition 40 to a desired storage surface. A given partition 40 may be fixed to the relevant storage surface exclusively by an adhesive bond between the bottom surface 44 of the partition 40 and the relevant storage surface.

The upper segment 50 of the partition 40 may be of any appropriate height and width. The partition 40 is at least generally T-shaped in the illustrated embodiment, with the upper segment 50 being disposed at least generally in the middle of the base 42 (in relation to its corresponding width dimension). The base 42 is of a first width and the upper segment 50 is of a second width, with base 42 being wider than the upper segment 50 (e.g., for enhanced stability of the partition 40 when fixed to the relevant storage surface), and with the width dimension of both the base 42 and upper segment 50 being orthogonal to the length dimension of the partition 40.

The partition 40 is formed from a material that allows it to be bent, flexed, or shaped along/relative to its length dimension. Representative materials for the partition 40 include without limitation natural rubber, flexible PVC, EPDM rubber, and thermoplastic elastomers (e.g., natural rubber, flexible PVC, EPDM rubber, chloroprene, neoprene, nitrile rubber, fluoroelastomer, styrene-butadiene rubber, styrene-ethylene-butylene-styrene, thermoplastic vulcanizates, thermoplastic olefin, thermoplastic polyurethane, polyethylene, polypropylene (styrene-ethylene-butylene-styrene, thermoplastic vulcanizates, and thermoplastic polyurethane are all in the broader thermoplastic elastomer group)). However, preferably the partition 40 also is of a sufficient hardness so as to be able to provide a sufficient restraint for one or more objects. The partition 40 may have a Shore Hardness within a range of about 70A to about 90A, for instance about 85A.

As shown in FIG. 1, one or more of the partitions 40 may include one or more curved sections along its length when adhesively bonded to the relevant storage surface. A partition 40 may be of a sufficient flexibility such that it may be shaped with a curved section defined by a minimum radius of about 1". A given partition 40 may be shaped to have a plurality of different curved sections (e.g., where two different curved sections are defined by a different radius of curvature; e.g., subject to the above-noted minimum radius) when adhesively bonded to the relevant storage surface.

In at least certain cases, it may be desirable for a given partition 40 to be disposed at least generally in the shape of a perimeter of a component to be disposed on the relevant storage surface. For instance and as shown in FIG. 5, a partition 40 may be flexed so as to have a first section 52 that is disposed alongside at least part of one side of a tool 30, a second section 54 that is disposed alongside at least part of an opposite side of the tool 30, and an end section 56 that extends between these sections 52, 54 and that is disposed alongside an end of the tool 30.

The above-described partition 40 provide benefits in relation to customized storage spaces. A given partition 40 may be cut to length (e.g., with a scissors) from a bulk source (e.g., a roll). A given partition 40 may also be disposed in a desired shape or contour along its length dimension (by its flexibility and prior to being adhesively bonded to the relevant storage surface) so as to provide a customized storage compartment or space for one or more articles/components. Finally, no connectors are needed to attach either end of a given partition 40 to another structure to dispose the partition 40 in a fixed position to the relevant storage surface—the adhesive bond between the bottom surface 44 of the partition 40 and the relevant storage surface can provide the entirety of the fixed connection between the partition 40 and the relevant storage surface.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

Any feature of any other various aspects addressed in this disclosure that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular. Moreover, any failure to use phrases such as "at least one" also does not limit the corresponding feature to the singular. Use of the phrase "at least substantially," "at least generally," or the like in relation to a particular feature encompasses the corresponding characteristic and insubstantial variations thereof (e.g., indicating that a surface is at least substantially or at least generally flat encompasses the surface actually being flat and insubstantial variations thereof). Finally, a reference of a feature in conjunction with the phrase "in one embodiment" does not limit the use of the feature to a single embodiment.

What is claimed is:

1. A storage system comprising:

a storage surface;

a partition that is attached to said storage surface by an adhesive bond between a bottom surface of said partition and said storage surface, wherein said partition comprises a Shore Hardness within a range of about 70A to about 90A, wherein said partition comprises a base and an upper segment that extends upwardly from said base and terminates at a free end, wherein each of said base and said upper segment extend along at least substantially an entirety of a length dimension of said partition, wherein said partition is flexible along said length dimension of said partition prior to being adhesively bonded to said storage surface, wherein said base comprises said bottom surface, wherein said base is wider than said upper segment and with a width dimension of said base and said upper segment being orthogonal to said length dimension of said partition, and wherein said bottom surface of said partition comprises a recess that extends along an entirety of said length dimension of said partition;

adhesive disposed in said recess; and at least one tool disposed on said storage surface in a space defined at least in part by said partition.

2. The storage system of claim 1, further comprising:

a drawer that in turn comprises a drawer bottom, wherein said storage surface defines said drawer bottom.

3. The storage system of claim 2, wherein said at least one tool comprises a first tool disposed on said drawer bottom, wherein said partition at least generally approximates a perimeter of at least a portion of said first tool.

4. The storage system of claim 2, wherein said at least one tool comprises a first tool disposed on said drawer bottom, wherein said partition extends along at least part of a first side of said tool, around an end of said tool, and along at least part of a second side of said tool opposite said first side.

5. The storage system of claim 1, further comprising:

a shelf that in turn comprises an upper shelf surface, wherein said upper shelf surface comprises said storage surface.

6. The storage system of claim 5, wherein said storage surface is one of horizontally disposed or disposed at an angle relative to horizontal.

7. The storage system of claim 1, wherein said partition comprises a T-shaped cross-section taken perpendicular to said length dimension.

8. The storage system of claim 1, wherein said upper segment is disposed at least generally at a middle of said base relative to said width dimension of said base.

9. The storage system of claim 1, wherein said partition comprises a release liner disposed over said adhesive in said recess, wherein said release liner is removable to expose said adhesive prior to disposing said partition on said storage surface.

10. The storage system of claim 9, wherein said adhesive is an acrylic adhesive.

11. The storage system of claim 1, wherein said adhesive comprises a double-sided adhesive tape mounted to said bottom surface of said base.

12. The storage system of claim 1, wherein said partition is formed from a material selected from the group consisting of natural rubber, flexible PVC, EPDM rubber, and thermoplastic elastomers.

13. The storage system of claim 1, wherein said partition is fixed to said storage surface exclusively by said adhesive bond between said bottom surface of said partition and said storage surface.

* * * * *